US012723366B2

(12) United States Patent
Nishihara et al.

(10) Patent No.: US 12,723,366 B2
(45) Date of Patent: Sep. 1, 2026

(54) SYSTEM AND METHOD FOR CONTROLLING WORK MACHINE

(71) Applicant: KOMATSU LTD., Tokyo (JP)

(72) Inventors: Ken Nishihara, Tokyo (JP); Eiji Ishibashi, Tokyo (JP); Takuya Sonoda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 442 days.

(21) Appl. No.: 18/571,972

(22) PCT Filed: Jul. 27, 2022

(86) PCT No.: PCT/JP2022/028962
§ 371 (c)(1),
(2) Date: Dec. 19, 2023

(87) PCT Pub. No.: WO2023/053700
PCT Pub. Date: Apr. 6, 2023

(65) Prior Publication Data

US 2024/0295096 A1 Sep. 5, 2024

(30) Foreign Application Priority Data

Sep. 30, 2021 (JP) ..... 2021-161624

(51) Int. Cl.
*E02F 3/84* (2006.01)
*E02F 3/85* (2006.01)
(Continued)

(52) U.S. Cl.
CPC ..... *E02F 3/841* (2013.01); *E02F 3/907* (2013.01); *E02F 9/265* (2013.01)

(58) Field of Classification Search
CPC . E02F 3/841; E02F 9/265; E02F 3/844; E02F 3/907; E02F 3/76
See application file for complete search history.

(56) References Cited

U.S. PATENT DOCUMENTS 9,988,787 B1 6/2018 Wang et al.
10,066,367 B1 * 9/2018 Wang ..... E02F 9/262
(Continued)

FOREIGN PATENT DOCUMENTS

JP 2001-159518 A 6/2001
JP 2014-31696 A 2/2014

OTHER PUBLICATIONS

The International Search Report for the corresponding international application No. PCT/JP2022/028962, issued on Sep. 13, 2022.

*Primary Examiner* — Scott A Browne
*Assistant Examiner* — Rami Nabih Bedewi
(74) *Attorney, Agent, or Firm* — Spencer Fane LLP

(57) ABSTRACT

A system includes a work implement sensor attached to a work implement to detect work implement roll and pitch angles, and a controller. The controller acquires an actual frame length, a position of the first body connecting portion, and the roll and pitch angles. The controller calculates an assumed position of the first frame connecting portion when the yaw angle is assumed to be a predetermined angle based on the roll and pitch angles in the first posture, an assumed frame length indicating a distance between the assumed position of the first frame connecting portion and the first body connecting portion, the yaw angle of the work implement in the first posture based on a difference between the actual and assumed frame lengths, and a position of the predetermined portion of the work implement based on the roll, pitch and yaw angles of the work implement in the first posture.

10 Claims, 6 Drawing Sheets

(51) Int. Cl.

| | |
|---|---|
| ***E02F 3/90*** | (2006.01) |
| ***E02F 9/20*** | (2006.01) |
| ***E02F 9/26*** | (2006.01) |

(56) References Cited

U.S. PATENT DOCUMENTS

| | | | | |
|---|---|---|---|---|
| 2014/0345889 | A1 | 11/2014 | Nakata et al. | |
| 2016/0319511 | A1* | 11/2016 | Chang | E02F 3/844 |
| 2017/0284067 | A1 | 10/2017 | Tevis et al. | |
| 2019/0235529 | A1* | 8/2019 | Barrick | A01B 23/043 |
| 2020/0181884 | A1* | 6/2020 | Green | G01C 19/00 |
| 2021/0372083 | A1* | 12/2021 | Velde | E02F 3/844 |
| 2022/0170239 | A1* | 6/2022 | Kean | E02F 9/265 |
| 2023/0054208 | A1* | 2/2023 | Kuehn | E02F 9/205 |

* cited by examiner

SYSTEM AND METHOD FOR CONTROLLING WORK MACHINE

CROSS-REFERENCE TO RELATED APPLICATIONS

This application is a U.S. National stage application of International Application No. PCT/JP2022/028962, filed on Jul. 27, 2022. This U.S. National stage application claims priority under 35 U.S.C. § 119(a) to Japanese Patent Application No. 2021-161624, filed in Japan on Sep. 30, 2021, the entire contents of which are hereby incorporated herein by reference.

BACKGROUND

Field of the Invention

The present invention relates to a system and a method for controlling a work machine.

Background Information

Some work machines are equipped with a work implement such as a blade. For example, in the work machine disclosed in Japanese Patent Application Publication No. 2014-31696, the blade and the vehicle body are connected by left and right lift frames. Left and right pitch/tilt cylinders are connected to the left and right lift frames, respectively. The blade performs a tilt motion when the left and right pitch/tilt cylinders expand and contract, respectively. The tilt motion is a motion in which the blade tilts from side to side so that the height of one of the left and right ends of the blade is different from the height of the other.

SUMMARY

In recent years, in order to control the work implement, the position of a predetermined portion of the work implement is detected by a controller of the work machine. Therefore, the work machine is equipped with a work implement sensor that detects the posture of the work implement and a frame sensor that detects the posture of the frame. Each sensor is, for example, an acceleration sensor, and detects a roll angle and a pitch angle from the gravitational acceleration. If the work implement's yaw angle relative to the vehicle body is zero degrees, the controller can calculate the position of the predetermined portion of the work implement with respect to the vehicle body based on the length, the roll angle, and the pitch angle of the frame, the roll angle and the pitch angle of the work implement, and the position of the predetermined portion in the work implement.

However, when the blade tilts, one of the left and right frames swings, so that the heights of the left and right frames become different from each other. In that case, the positions of the front ends of the left and right frames are shifted from each other in the front-back direction. Therefore, the yaw angle of the work implement with respect to the vehicle body has a value different from zero degrees. In that case, with the method described above, it is difficult to accurately detect the position of the work implement with respect to the vehicle body.

On the other hand, according to the above-mentioned acceleration sensor, the yaw angle of the work implement can be calculated by integrating the angular velocities, assuming that the yaw angle at the starting time is 0.

However, the accuracy is not high, and the error becomes large when used for a long time. Therefore, even when the yaw angle is detected using an acceleration sensor, it is not easy to accurately detect the position of the work implement with respect to the vehicle body. An object of the present invention is to accurately detect the position of a predetermined portion of a work implement in a work machine even if the yaw angle of the work implement changes due to the movement of the work implement.

Solution to Problems

A system according to one aspect of the present invention is a system for controlling a work machine. The work machine includes a vehicle body, a work implement frame, a work implement, a first actuator, and a second actuator. The work implement frame includes a first frame and a second frame. The first frame includes a first body connecting portion connected to the vehicle body. The second frame includes a second body connecting portion connected to the vehicle body. The second frame is disposed apart from the first frame in the left-right direction.

The work implement includes a first frame connecting portion, a second frame connecting portion, and a predetermined portion. The first frame connecting portion is connected to the first frame. The second frame connecting portion is disposed apart from the first frame connecting portion in the left-right direction. The second frame connecting portion is connected to the second frame. The first actuator moves the first frame relative to the vehicle body. The second actuator moves the second frame relative to the vehicle body. The yaw angle of the work implement with respect to the vehicle body when the work implement is in a first posture is different from the yaw angle of the work implement when the work implement is in a second posture. The second posture is different from the first posture.

The system includes a work implement sensor and a controller. The work implement sensor is attached to the work implement. The work implement sensor detects the roll angle and the pitch angle of the work implement. The controller acquires an actual frame length indicating the distance between the first body connecting portion and the first frame connecting portion. The controller acquires the position of the first body connecting portion. The controller acquires the roll angle and the pitch angle of the work implement.

When the work implement is in the first posture, the controller calculates an assumed position of the first frame connecting portion when the yaw angle is assumed to be a predetermined angle based on the roll angle and the pitch angle of the work implement. The controller calculates an assumed frame length indicating the distance between the assumed position of the first frame connecting portion and the first body connecting portion. The controller calculates the yaw angle of the work implement in the first posture based on the difference between the actual frame length and the assumed frame length. The controller calculates the position of the predetermined portion of the work implement based on the roll angle and the pitch angle of the work implement and the yaw angle of the work implement in the first posture.

A method according to another aspect of the present invention is a method for controlling a work machine. The work machine includes a vehicle body, a work implement frame, a work implement, a first actuator, and a second actuator. The work implement frame includes a first frame and a second frame. The first frame includes a first body connecting portion connected to the vehicle body. The second frame includes a second body connecting portion connected to the vehicle body. The second frame is disposed apart from the first frame in the left-right direction.

The work implement includes a first frame connecting portion, a second frame connecting portion, and a predetermined portion. The first frame connecting portion is connected to the first frame. The second frame connecting portion is disposed apart from the first frame connecting portion in the left-right direction. The second frame connecting portion is connected to the second frame. The yaw angle of the work implement with respect to the vehicle body when the work implement is in a first posture is different from the yaw angle of the work implement when the work implement is in a second posture. The second posture is different from the first posture.

The method includes detecting a position of the first body connecting portion: detecting the roll angle and the pitch angle of the work implement: acquiring an actual frame length indicating a distance between the first body connecting portion and the first frame connecting portion: calculating an assumed position of the first frame connecting portion when the yaw angle is assumed to be a predetermined angle based on the roll angle and the pitch angle of the work implement when the work implement is in the first posture: calculating an assumed frame length indicating the distance between the assumed position of the first frame connecting portion and the first body connecting portion: calculating the yaw angle of the work implement in the first posture based on the difference between the actual frame length and the assumed frame length; and calculating the position of the predetermined position of the work implement based on the roll angle and the pitch angle of the work implement, and the yaw angle of the work implement in the first posture.

Advantageous Effects of Invention

According to the present invention, the yaw angle when the work implement is in the first posture is calculated from the difference between the assumed frame length and the actual frame length when the yaw angle of the work implement is assumed to be a predetermined angle. As a result, even if the yaw angle of work implement changes due to the movement of the work implement, the position of work implement can be accurately detected on the work machine.

DETAILED DESCRIPTION OF EMBODIMENT(S)

Figure 1:
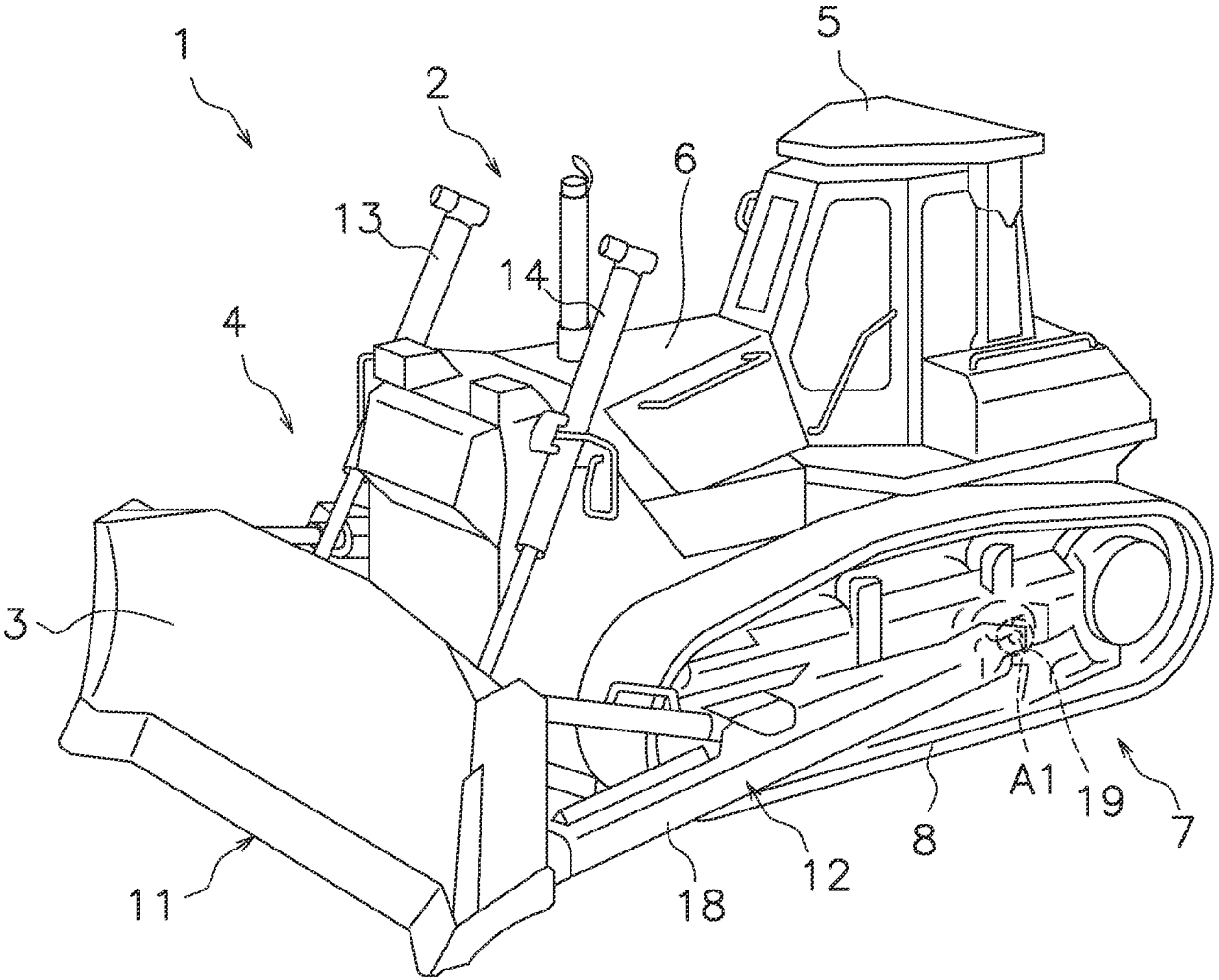
FIG. 1 is a perspective view of a work machine.

Hereinafter, a work machine according to an embodiment will be described with reference to the drawings. FIG. 1 is a perspective view showing a work machine 1 according to an embodiment. The work machine 1 according to the present embodiment is a bulldozer. The work machine 1 includes a vehicle body 2, a work implement 3, and a drive mechanism 4 for the work implement 3.

The vehicle body 2 includes a cab 5, a power compartment 6, and a traveling device 7. A driver's seat (not shown) is disposed in the cab 5. The power compartment 6 is disposed in front of the cab 5. The traveling device 7 supports the vehicle body 2. The traveling device 7 includes left and right crawler tracks 8. Note that in FIG. 1, only the left crawler track 8 is illustrated. The work machine 1 travels as the crawler track 8 rotates.

Figure 2:
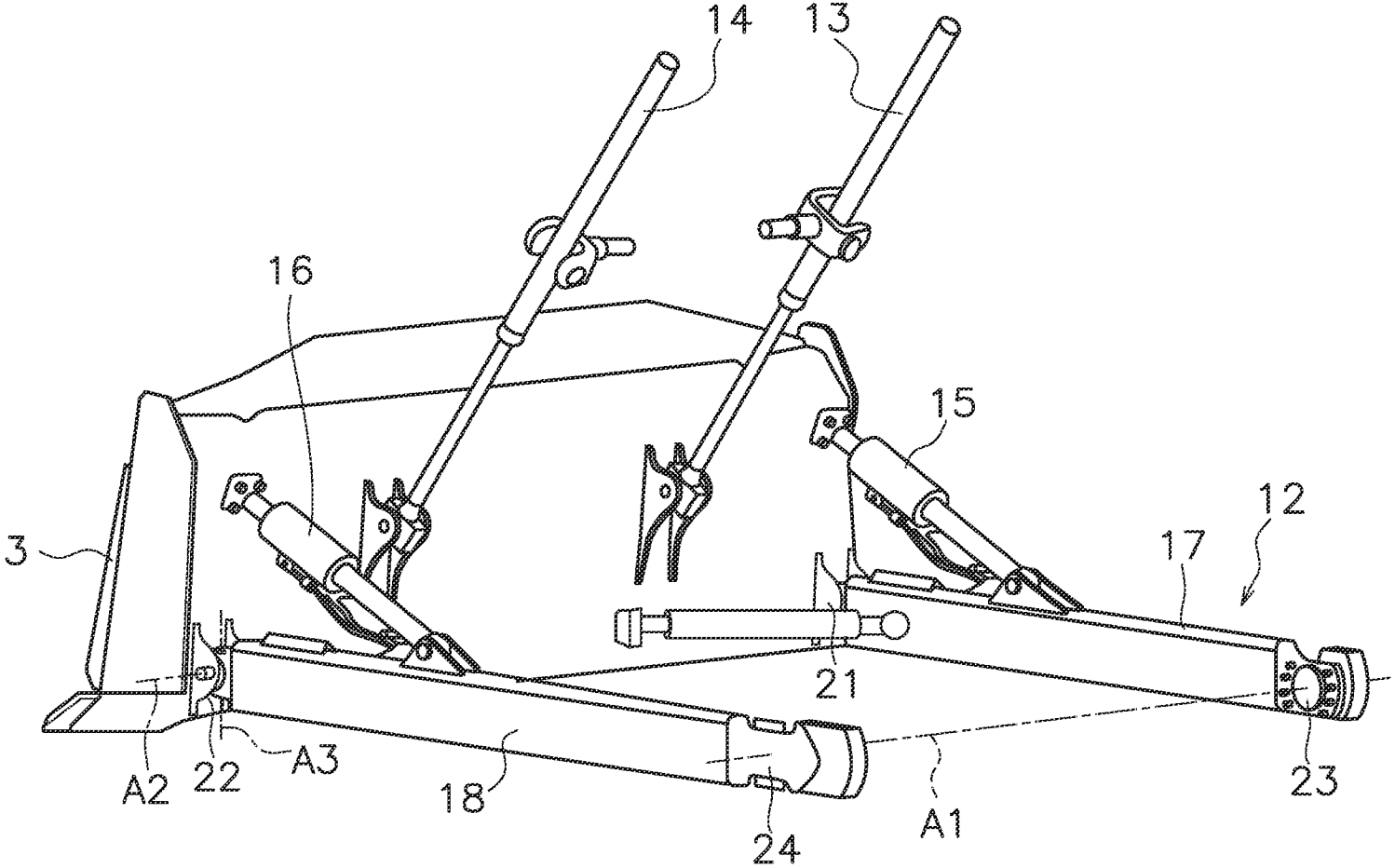
FIG. 2 is a perspective view of a work implement and its surrounding structure.

The work implement 3 is disposed in front of the vehicle body 2. In this embodiment, the work implement 3 is a blade. The work implement 3 extends in the left-right direction of the work machine 1. The work implement 3 includes a cutting edge 11. The drive mechanism 4 for the work implement 3 includes a work implement frame 12 and a plurality of actuators 13 to 16. FIG. 2 is a perspective view of the work implement 3 and the drive mechanism 4. As shown in FIG. 2, the work implement frame 12 supports the work implement 3. The work implement frame 12 includes a first frame 17 and a second frame 18. The first frame 17 and the second frame 18 extend in the front-rear direction of the work machine 1.

The first frame 17 is swingably connected to the vehicle body 2. The first frame 17 includes a first body connecting portion 23. The first frame 17 is connected to the vehicle body 2 at the first body connecting portion 23. The second frame 18 is disposed apart from the first frame 17 in the left-right direction. The second frame 18 is swingably connected to the vehicle body 2. The second frame 18 includes a second body connecting portion 24. The second frame 18 is connected to the vehicle body 2 at the second body connecting portion 24.

The first frame 17 and the second frame 18 swing at least about the lift axis A1 with respect to the vehicle body 2. The lift axis A1 extends in the left-right direction of the work machine 1. Specifically, the first frame 17 and the second frame 18 are connected to the vehicle body 2 via a ball joint 19, and are swingable in all directions relative to the vehicle body 2. As shown in FIG. 1, the first frame 17 and the second frame 18 are disposed outside the traveling device 7 in the left-right direction. The first frame 17 and the second frame 18 are connected to the side surfaces of the traveling device 7.

As shown in FIG. 2, the work implement 3 includes a first frame connecting portion 21 and a second frame connecting portion 22. The first frame connecting portion 21 and the second frame connecting portion 22 are disposed on the back surface of the work implement 3. The first frame connecting portion 21 is connected to the first frame 17. The second frame connecting portion 22 is disposed apart from the first frame connecting portion 21 in the left-right direction. The second frame connecting portion 22 is connected to the second frame 18. The work implement 3 is supported by the first frame 17 and the second frame 18 so as to be rotatable about a first axis A2 and a second axis A3. The first axis A2 extends in the left-right direction of the work machine 1. The second axis A3 extends in the vertical direction of the work machine 1.

The plurality of actuators 13 to 16 include a first lift actuator 13, a second lift actuator 14, a first pitch/tilt actuator 15, and a second pitch/tilt actuator 16. The first lift actuator 13 and the second lift actuator 14 are disposed apart from each other in the left-right direction of the work machine 1. The first lift actuator 13 and the second lift actuator 14 are connected to the vehicle body 2 and the work implement 3. The first lift actuator 13 and the second lift actuator 14 are hydraulic cylinders. The first lift actuator 13 and the second lift actuator 14 swing the work implement frame 12 up and down about the lift axis A1. Thereby, the work implement 3 is lifted up and down.

The first pitch/tilt actuator 15 and the second pitch/tilt actuator 16 are disposed apart from each other in the left-right direction of the work machine 1. The first pitch/tilt actuator 15 is connected to the work implement 3 and the first frame 17. The second pitch/tilt actuator 16 is connected to the work implement 3 and the second frame 18. The first pitch/tilt actuator 15 and the second pitch/tilt actuator 16 are hydraulic cylinders.

The first pitch/tilt actuator 15 rotates the work implement 3 about the first axis A2 with respect to the first frame 17. The second pitch/tilt actuator 16 rotates the work implement 3 about the first axis A2 with respect to the second frame 18. By expanding and contracting both the first pitch/tilt actuator 15 and the second pitch/tilt actuator 16, the work implement 3 tilts forward or backward about the first axis A2. This tilting motion of the work implement 3 back and forth is called a pitch motion.

When only one of the first pitch/tilt actuator 15 and the second pitch/tilt actuator 16 expands or contracts, the work implement 3 tilts to the left or right. For example, by expanding and contracting only the first pitch/tilt actuator 15, the right end of the work implement 3 moves up and down. By expanding and contracting only the second pitch/tilt actuator 16, the left end of the work implement 3 moves up and down. As a result, the work implement 3 is tilted so that the heights of the left end and the right end of the work implement 3 are different from each other. This left and right tilting motion of the work implement 3 is called a tilt motion.

Figure 3:
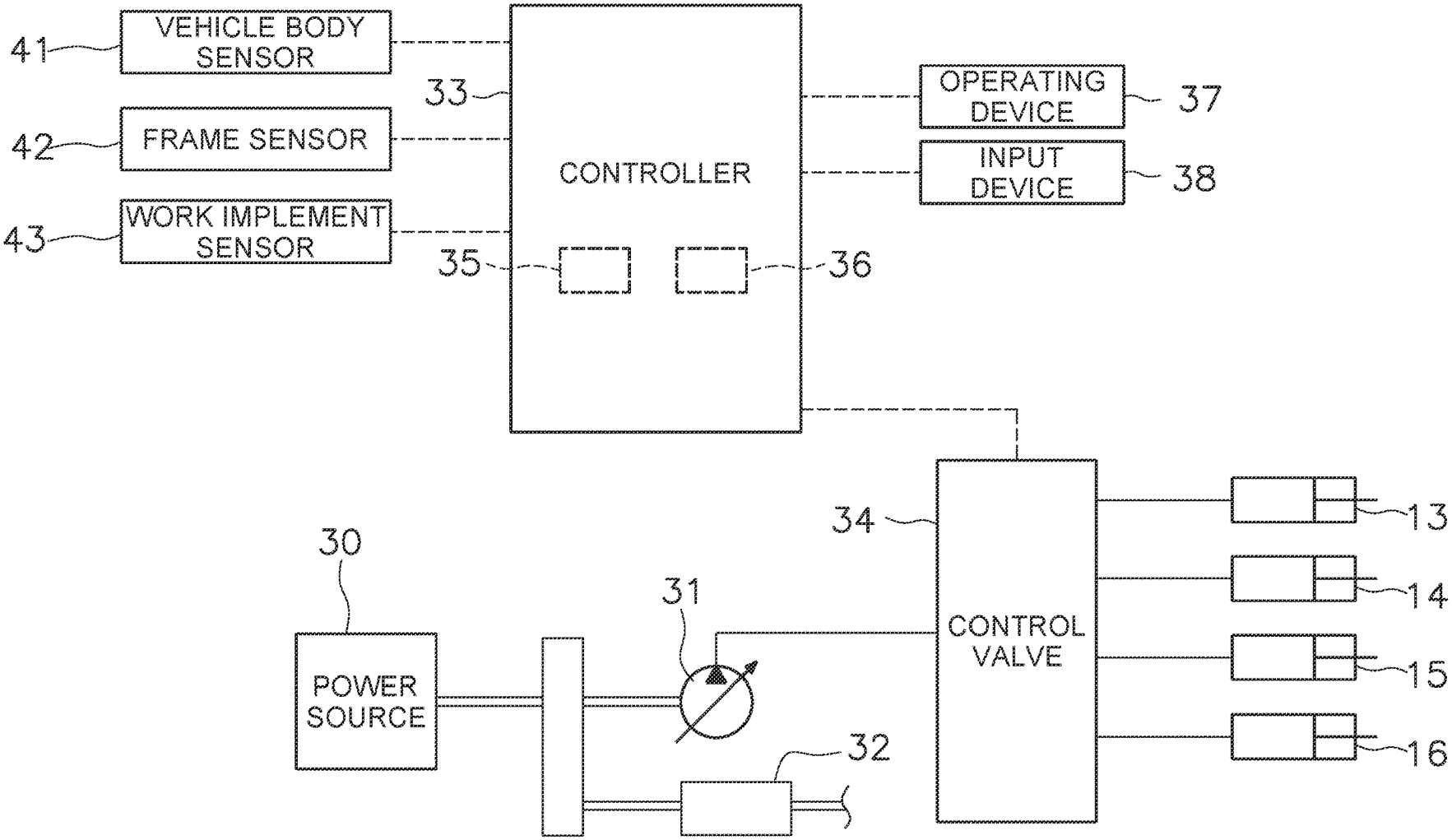
FIG. 3 is a block diagram showing a control system for the work machine.

FIG. 3 is a block diagram showing a configuration of a control system of the work machine 1. As shown in FIG. 3, the work machine 1 includes a power source 30, a hydraulic pump 31, and a power transmission device 32. The power source 30 is, for example, an internal combustion engine. However, the power source 30 may be an electric motor. Alternatively, the power source 30 may be a hybrid of an internal combustion engine and an electric motor.

The hydraulic pump 31 is driven by the power source 30 and discharges hydraulic fluid. The hydraulic fluid discharged from the hydraulic pump 31 is supplied to the lift actuators 13 and 14 and the pitch/tilt actuators 15 and 16. Note that although one hydraulic pump 31 is illustrated in FIG. 3, a plurality of hydraulic pumps may be provided.

The power transmission device 32 transmits the driving force of the power source 30 to the traveling device 7. The power transmission device 32 may be, for example, an HST (Hydro Static Transmission). Alternatively, the power transmission device 32 may be, for example, a torque converter or a transmission having multiple speed change gears.

The work machine 1 includes a controller 33 and a control valve 34. The controller 33 is programmed to control the work machine 1 based on the acquired data. The controller 33 includes a storage device 35 and a processor 36. The processor 36 includes, for example, a CPU. The storage device 35 includes, for example, a memory and an auxiliary storage device. The storage device 35 may be, for example, a RAM or a ROM. The storage device 35 may be a semiconductor memory, a hard disk, or the like. The storage device 35 is an example of a non-transitory computer-readable recording medium. The storage device 35 records computer instructions executable by processor 36 to control the work machine 1.

The control valve 34 is controlled by a command signal from the controller 33. The control valve 34 is disposed between the actuators 13 to 16 and the hydraulic pump 31. The control valve 34 controls the flow rate of hydraulic fluid supplied from the hydraulic pump 31 to the lift actuators 13 and 14. The control valve 34 controls the flow rate of hydraulic fluid supplied from the hydraulic pump 31 to the pitch/tilt actuators 15 and 16.

The work machine 1 includes an operating device 37 and an input device 38. The operating device 37 includes, for example, a lever. Alternatively, the operating device 37 may include a pedal or a switch. An operator can use the operating device 37 to manually control the running of the work machine 1 and the operation of the work implement 3. For example, the operating device 37 can operate a lift motion, a pitch motion, and a tilt motion of the work implement 3. The operating device 37 outputs an operation signal indicating the operation of the operating device 37. The controller 33 receives the operation signal from the operating device 37.

The input device 38 includes, for example, a touch screen. However, input device 38 may include other devices such as a switch. The operator can use the operating device 37 to set the control of the work machine 1. The input device 38 outputs an input signal indicating an input to input device 38. The controller 33 receives the input signal from input device 38.

The work machine 1 includes a vehicle body sensor 41, a frame sensor 42, and a work implement sensor 43. The vehicle body sensor 41 is attached to the vehicle body 2. The vehicle body sensor 41 detects the posture of the vehicle body 2. The frame sensor 42 is attached to the work implement frame 12. The frame sensor 42 detects the posture of the work implement frame 12. The work implement sensor 43 is attached to the work implement 3. The work implement sensor 43 detects the posture of the work implement 3.

The vehicle body sensor 41, the frame sensor 42, and the work implement sensor 43 are, for example, acceleration sensors such as IMUs (Inertial Measurement Units). However, the vehicle body sensor 41, the frame sensor 42, and the work implement sensor 43 are not limited to the IMU, and may be other acceleration sensors.

The vehicle body sensor 41 detects the pitch angle, the roll angle, and the yaw angle of the vehicle body 2. The frame sensor 42 detects the pitch angle, the roll angle, and the yaw angle of the work implement frame 12. Specifically, the frame sensor 42 is attached to the second frame 18. The frame sensor 42 detects the pitch angle, the roll angle, and the yaw angle of the second frame 18. The work implement sensor 43 detects the pitch angle, the roll angle, and the yaw angle of the work implement 3.

Each sensor detects the pitch angle and the roll angle based on gravitational acceleration. Furthermore, each sensor detects the yaw angle by integrating the angular velocity, with the yaw angle at the starting time is 0. The vehicle body sensor 41, the frame sensor 42, and the work implement sensor 43 each output a detection signal indicating the detected angle.

The controller 33 detects the position of a predetermined portion of the work implement 3 with respect to the vehicle body 2 based on the angles detected by the above-mentioned sensors 41 to 43 and a shape data of the work machine 1. The shape data of the work machine 1 is stored in the controller 33 and indicates the positional relationship of each part of the work machine 1. Hereinafter, a method for detecting the position of a predetermined portion of the work implement 3 will be explained.

Figure 4A:
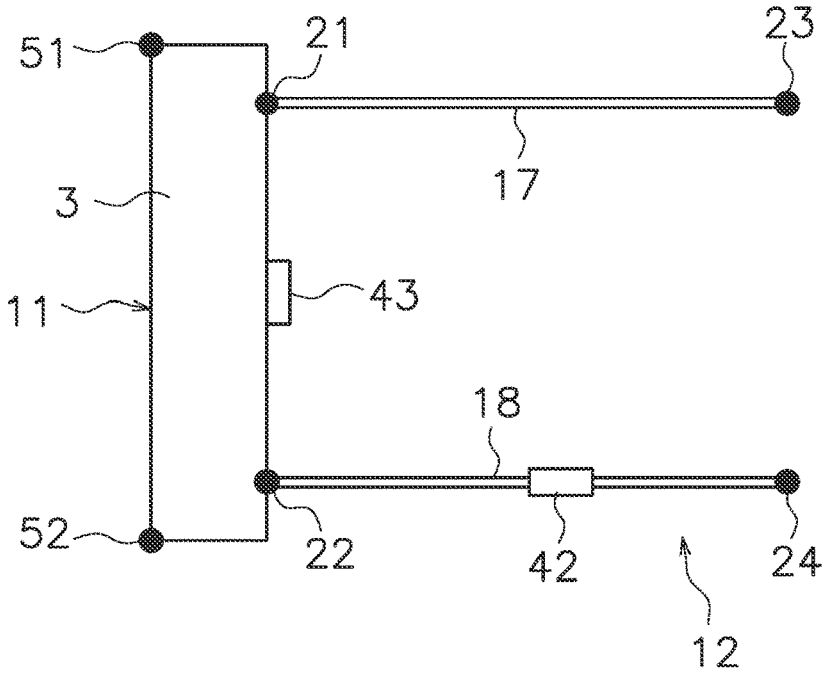
FIG. 4A is a top view schematically showing the work implement and a work implement frame in a standard posture.
Figure 4B:
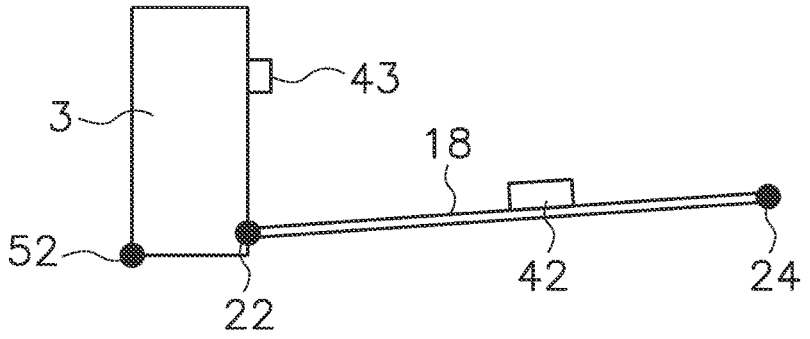
FIG. 4B is a side view schematically showing the work implement and the work implement frame in the standard posture.
Figure 4C:
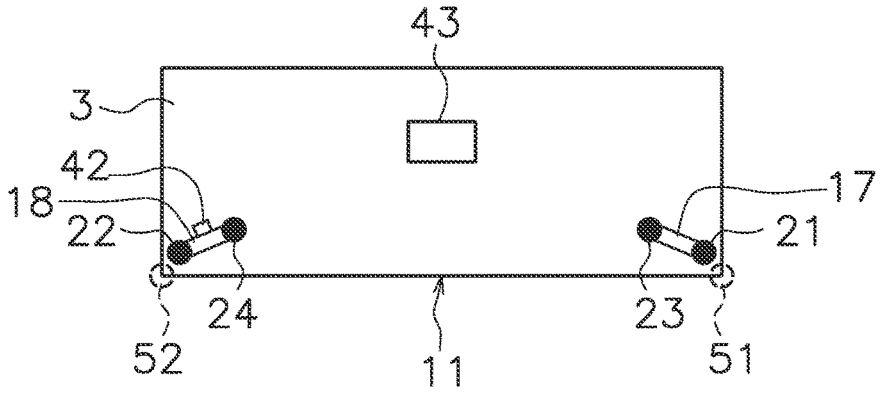
FIG. 4C is a rear view schematically showing the work implement and the work implement frame in the standard posture.

FIGS. 4A to 4C are schematic diagrams showing the work implement 3 and the work implement frame 12 in a standard posture. FIG. 4A is a top view: FIG. 4B is a side view: FIG. 4C is a rear view: As shown in FIG. 4C, in the standard posture, the cutting edge 11 of the work implement 3 is horizontal, and a first end 51 and a second end 52 of the cutting edge 11 of the work implement 3 are located at the same height. Further, the first frame 17 and the second frame 18 are located at the same height. The longitudinal direction of the work implement 3 and the longitudinal direction of the vehicle body 2 match, and the yaw angle of the work implement 3 with respect to the vehicle body 2 is zero degrees.

The first end 51 and the second end 52 are the left and right ends of the cutting edge 11. As shown in FIG. 4A, the first end 51 is the right end of the cutting edge 11, and the second end 52 is the left end of the cutting edge 11. However, the first end 51 and the second end 52 may be provided with the right and left sides reversed.

The shape data includes the position of the first body connecting portion 23 and the position of the second body connecting portion 24 in the vehicle body 2. For example, the position of the first body connecting portion 23 and the position of the second body connecting portion 24 are indicated by coordinates in a vehicle body coordinate system with the vehicle body 2 as a reference. The shape data includes a first actual frame length and a second actual frame length. The first actual frame length indicates the distance between the first body connecting portion 23 and the first frame connecting portion 21. The second actual frame length indicates the distance between the second body connecting portion 24 and the second frame connecting portion 22.

The shape data includes work implement data. The work implement data indicates the positional relationship between the second frame connecting portion 22 and a predetermined portion of the work implement 3. The predetermined portion is located, for example, on the cutting edge 11 of the work implement 3. In this embodiment, the predetermined portion includes the first end 51 and the second end 52 of the work implement 3.

When the work implement 3 is in the standard posture, the controller 33 calculates the positions of the first end 51 and the second end 52 of the work implement 3 as follows. The controller 33 calculates the position of the second frame connecting portion 22 from the position of the second body connecting portion 24 based on the pitch angle, the roll angle, and the yaw angle of the second frame 18 and the second actual frame length. The controller 33 calculates the position of the first end 51 of the work implement 3 from the position of the second frame connecting portion 22 based on the pitch angle, the roll angle, and the yaw angle of the work implement 3, and the work implement data. Here, the yaw angle of the work implement 3 with respect to the vehicle body 2 is zero degrees. Further, the controller 33 determines the position of the second end 52 of the work implement 3 from the position of the second frame connecting portion 22 based on the pitch angle, the roll angle, and the yaw angle of the work implement 3, and the work implement data.

Figure 5A:
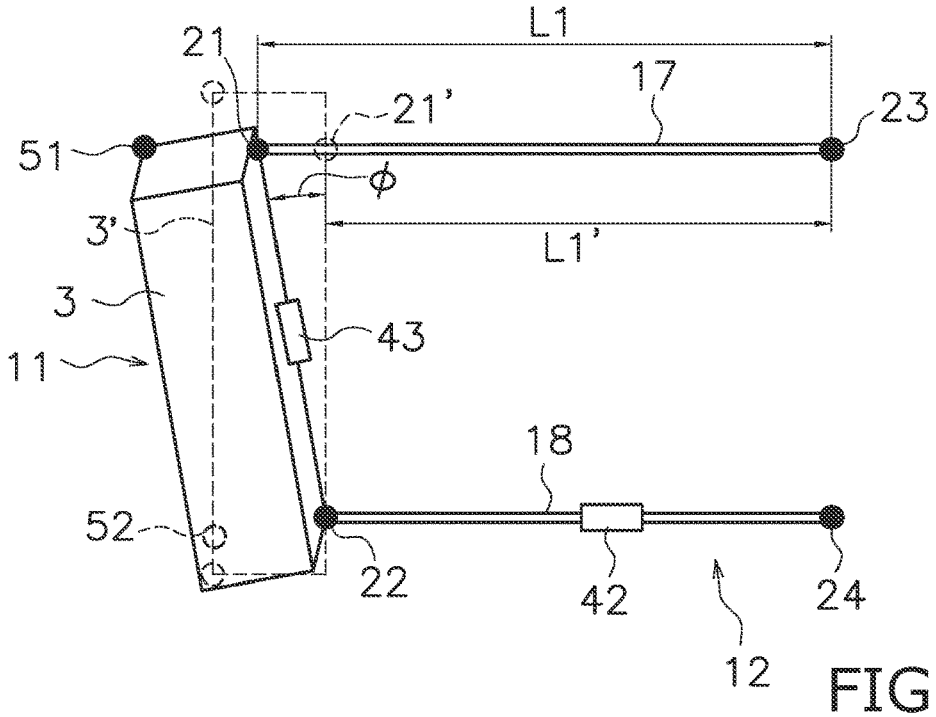
FIG. 5A is a top view schematically showing the work implement and the work implement frame in a tilted posture.
Figure 5B:
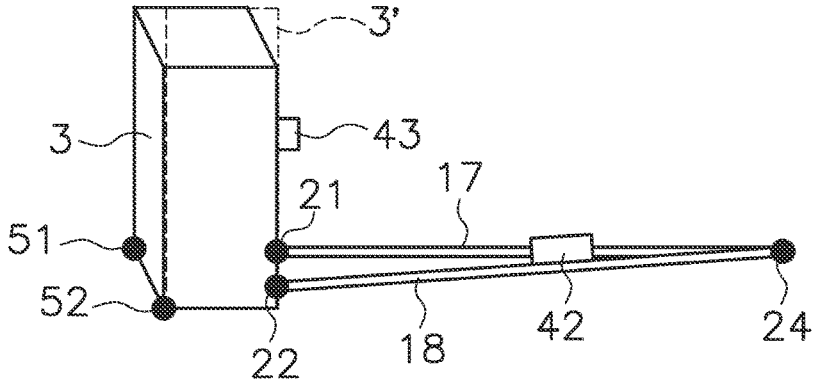
FIG. 5B is a side view schematically showing the work implement and the work implement frame in the tilted posture.
Figure 5C:
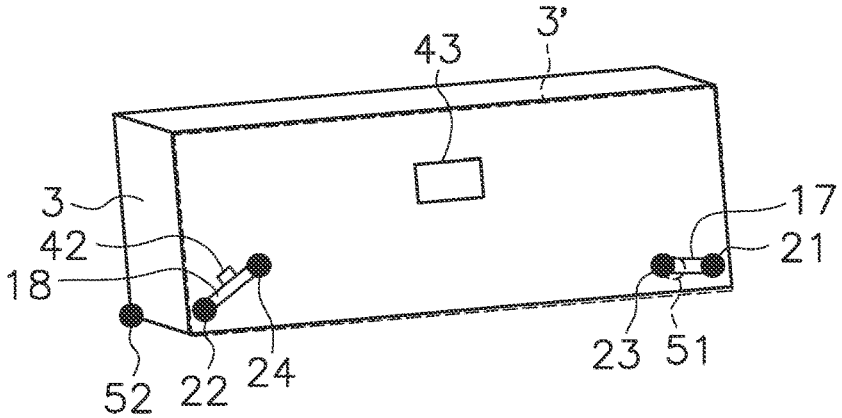
FIG. 5C is a rear view schematically showing the work implement and the work implement frame in the tilted posture.

FIGS. 5A to 5C are schematic diagrams showing the work implement 3 and the work implement frame 12 in a tilted posture. FIG. 5A is a top view: FIG. 5B is a side view: FIG. 5C is a rear view: As shown in FIG. 5C, in the tilted posture, the heights of the first end 51 and the second end 52 of the work implement 3 are different from each other. The first frame 17 and the second frame 18 are located at different heights. In this case, depending on the structure of the work machine 1, the yaw angle φ of the work implement 3 in the tilted posture may be different from the yaw angle of the work implement 3 in the standard position, and may be a value other than zero degrees, as shown in FIG. 5A. Note that in FIG. 5A, a broken line 3' indicates the work implement 3 when the yaw angle φ is zero degrees in the tilted posture.

Figure 6:
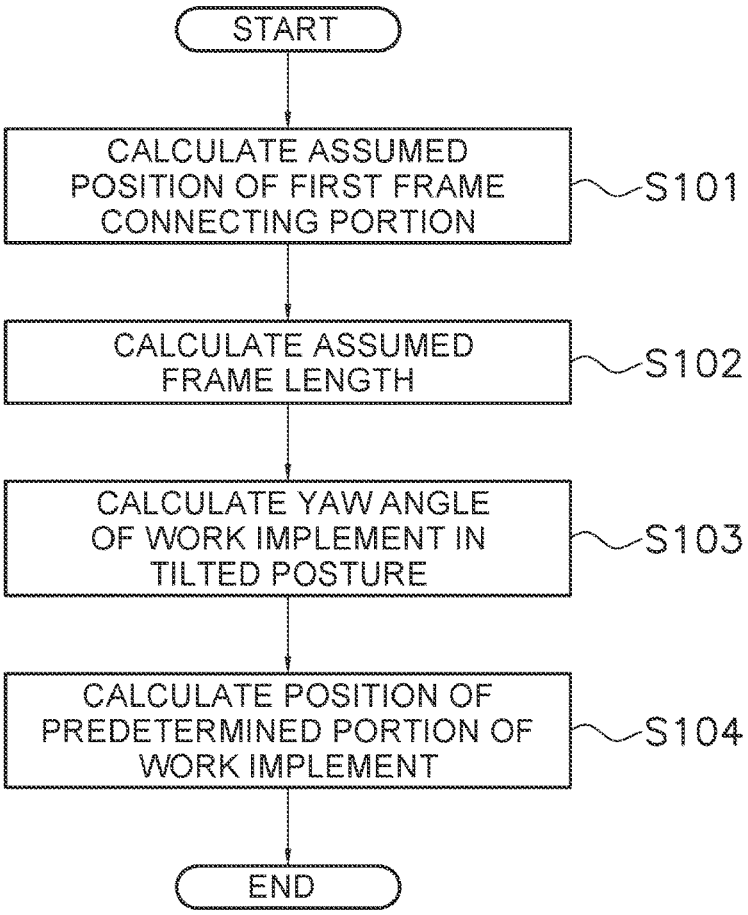
FIG. 6 is a flowchart illustrating a process for calculating a position of a predetermined portion of the work implement.

Next, a method for calculating the position of the predetermined portion of the work implement 3 when the work implement 3 is in the tilted posture will be described. As shown in FIG. 6, in step S101, the controller 33 calculates an assumed position of the first body connecting portion 23. As shown in FIG. 5A, the controller 33 calculates the assumed position 21' of the first frame connecting portion 21 based on the roll angle and the pitch angle of the work implement 3, assuming that the yaw angle φ is zero. For example, the controller 33 calculates the assumed position of the first frame connecting portion 21 using the following equation (1).

$$P21'=Rx(\delta)Ry(\theta)Rz(0)P21s \quad (1)$$

P21' is the coordinate of the assumed position 21' of the first frame connecting portion 21. P21s is the coordinate of the first frame connecting portion 21 in the standard posture. δ and θ are the amounts of change in the roll angle and the pitch angle, respectively, from the standard posture. Rx(δ), Ry(θ), and Rz(0) are rotation matrices of the roll angle, the pitch angle, and the yaw angle of the work implement 3, respectively.

In step S102, the controller 33 calculates an assumed frame length L1'. The assumed frame length L1' indicates the distance between the assumed position 21' of the first frame connecting portion 21 and the first body connecting portion 23. The controller 33 calculates the assumed frame length L1' from the coordinates of the assumed position 21' of the first frame connecting portion 21 and the coordinates of the position of the first body connecting portion 23.

In step S103, the controller 33 calculates the yaw angle φ of the work implement 3 in the tilted posture. The controller 33 calculates the yaw angle φ of the work implement 3 in the tilted posture based on the difference between the first actual frame length L1 and the assumed frame length L1'. The controller 33 calculates the yaw angle φ of the work implement 3 in the tilted posture using the following equation (2).

$$\varphi=\arcsin\{(L1-L1')/W\} \quad (2)$$

W is the width of the work implement 3.

In step S104, the controller 33 calculates the positions of the predetermined portions of the work implement 3. In this embodiment, the predetermined portions are the first end 51 and the second end 52 of the work implement 3. When the work implement 3 is in the tilted posture, the controller 33 calculates the positions of the first end 51 and the second end 52 of the work implement 3 based on the roll angle δ and the pitch angle θ of the work implement 3, and the yaw angle φ in the tilted posture. For example, the controller 33 calculates the position of the second end 52 of the work implement 3 using the following equation (3).

$$P52t=Rx(\delta)Ry(\theta)Rz(\varphi)P52s \quad (3)$$

P52t is the position of the second end 52 of the work implement 3 in the tilted posture. P52s is the position of the second end 52 of the work implement 3 in the standard posture. Note that, in the same manner as described above, the position of the first end 51 of the work implement 3 in the tilted posture may be calculated from the position of the first end 51 of the work implement 3 in the standard posture.

In the control system for the work machine 1 according to the present embodiment described above, the difference between the assumed frame length L1' of the first frame 17 and the actual frame length L1 when the yaw angle of the work implement 3 is assumed to be zero degrees. From this, the yaw angle φ when the work implement 3 is in the tilted posture is calculated. Thereby, even if the yaw angle of the work implement 3 changes due to the tilt motion, the position of the predetermined portion of the work implement 3 in the work machine 1 can be detected with high accuracy.

Figure 7:
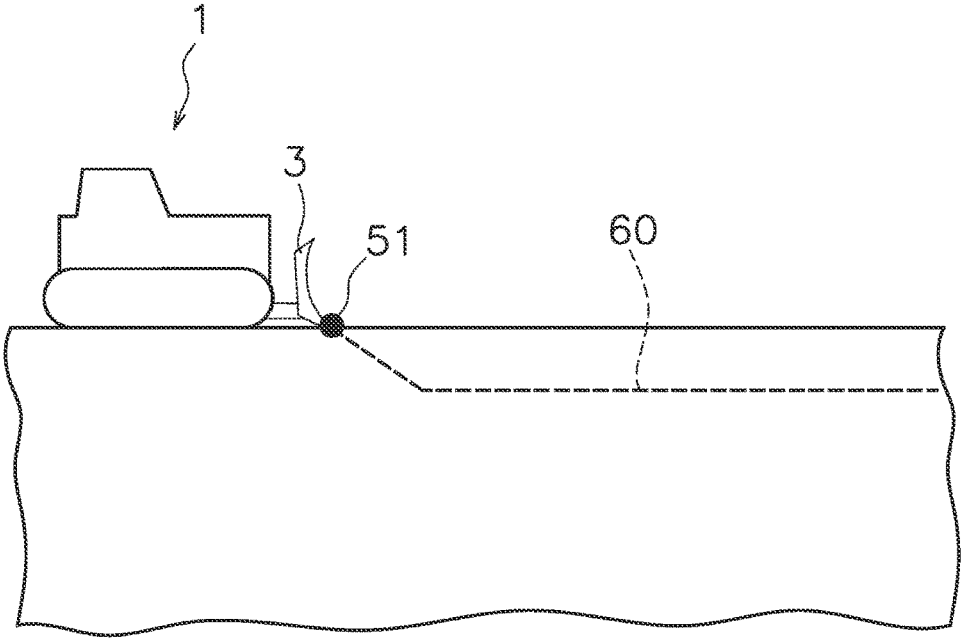
FIG. 7 is a diagram showing an example of control of the work machine.

Note that the controller 33 may control the work implement 3 to move based on the position of the predetermined portion of the work implement 3 detected as described above. For example, as shown in FIG. 7, the controller 33 may acquire a target design topography 60. The controller 33 may control the work machine 1 to move the predetermined portion of the work implement 3 according to the target design topography 60. For example, the controller 33 may acquire the target design topography 60 via the input device 38. The controller 33 may automatically generate the target design topography 60.

Although one embodiment of the present invention has been described above, the present invention is not limited to the above embodiment, and various changes can be made without departing from the gist of the invention.

The work machine 1 is not limited to a bulldozer, but may be another vehicle such as a wheel loader or a motor grader. The controller 33 may include a plurality of controllers that are separate from each other. The work machine 1 may be operable remotely. In that case, the controller 33, the operating device 37, and the input device 38 may be disposed outside the work machine 1. The controller 33 may control the work machine 1 by wireless communication with the work machine 1.

The processing by the controller 33 is not limited to that of the above embodiment, and may be modified. A part of the processing by the controller 33 may be omitted. Alternatively, part of the process described above may be changed.

For example, in the embodiment described above, the frame sensor 42 is attached to the second frame 18. However, the frame sensor 42 may be attached to the first frame 17. Alternatively, the frame sensor 42 may be attached to each of the first frame 17 and the second frame 18. In that case, the controller 33 may calculate the position of the predetermined portion of the work implement 3 from the position of the first frame connecting portion 21.

In the above embodiment, the yaw angle when the work implement 3 is in the tilted posture is calculated from the difference between the actual frame length L1 and the assumed frame length L1' of the first frame 17 when the yaw angle is assumed to be zero degrees. However, the yaw angle when the work implement 3 is in the tilted posture may be calculated from the difference between the actual frame length and the assumed frame length of the second frame 18 when the yaw angle is assumed to be zero degrees.

The predetermined angle may be an angle other than zero degrees. The posture of the work implement 3 used for calculating the yaw angle is not limited to the standard posture and the tilted posture described above, but may be any two or more postures with mutually different yaw angles.

The predetermined portion is not limited to the first end 51 and the second end 52 of the cutting edge 11 of the work implement 3, but may be another portion. For example, the predetermined portion may be the center of the cutting edge 11.

According to the present invention, even if the yaw angle of the work implement changes due to the tilt motion, the position of the predetermined portion of the work implement can be detected with high accuracy in the work machine.

The invention claimed is:

1. A system for controlling a work machine including a vehicle body, a work implement frame including a first frame including a first body connecting portion connected to the vehicle body, and a second frame disposed apart from the first frame in a left-right direction and including a second body connecting portion connected to the vehicle body, a work implement including a first frame connecting portion connected to the first frame, a second frame connecting portion disposed apart from the first frame connecting portion in the left-right direction and connected to the second frame, and a predetermined portion, a first actuator configured to operate the first frame relative to the vehicle body, and a second actuator configured to operate the second frame relative to the vehicle body, a yaw angle of the work implement with respect to the vehicle body when the work implement is in a first posture being different from a yaw angle of the work implement when the work implement is in a second posture different from the first posture, the system comprising:

a work implement sensor attached to the work implement to detect a roll angle and a pitch angle of the work implement; and a controller configured to acquire an actual frame length indicating a distance between the first body connecting portion and the first frame connecting portion, acquire a position of the first body connecting portion, acquire the roll angle and the pitch angle of the work implement, calculate an assumed position of the first frame connecting portion when the yaw angle is assumed to be a predetermined angle based on the roll angle and the pitch angle of the work implement when the work implement is in the first posture, calculate an assumed frame length indicating a distance between the assumed position of the first frame connecting portion and the first body connecting portion, calculate the yaw angle of the work implement in the first posture based on a difference between the actual frame length and the assumed frame length, and calculate a position of the predetermined portion of the work implement based on the roll angle and the pitch angle of the work implement and the yaw angle of the work implement in the first posture.

2. The system according to claim 1, wherein the controller is configured to control the work implement based on the position of the predetermined portion of the work implement.

3. The system according to claim 1, wherein the vehicle body further includes a traveling device configured to move the work machine, and the first frame and the second frame are disposed outside the traveling device in the left-right direction.

4. The system according to claim 1, wherein the work implement sensor is an acceleration sensor.

5. The system according to claim 1, wherein heights of a left end and a right end of the work implement in the first posture are different from each other, and the heights of the left end and the right end of the work implement in the second posture are the same.

6. The system according to claim 1, wherein the predetermined angle is zero degrees.

7. A method for controlling a work machine including a vehicle body, a work implement frame including a first frame including a first body connecting portion connected to the vehicle body, and a second frame disposed apart from the first frame in a left-right direction and including a second body connecting portion connected to the vehicle body, and a work implement including a first frame connecting portion connected to the first frame, a second frame connecting portion disposed apart from the first frame connecting portion in the left-right direction and connected to the second frame, and a predetermined portion, a yaw angle of the work implement with respect to the vehicle body when the work implement is in a first posture being different from a yaw angle of the work implement when the work implement is in a second posture different from the first posture, the method comprising:

acquiring a position of the first body connecting portion;

detecting a roll angle and a pitch angle of the work implement;

acquiring an actual frame length indicating a distance between the first body connecting portion and the first frame connecting portion;

calculating an assumed position of the first frame connecting portion when the yaw angle is assumed to be a predetermined angle based on the roll angle and the pitch angle of the work implement when the work implement is in the first posture, calculating an assumed frame length indicating a distance between the assumed position of the first frame connecting portion and the first body connecting portion;

calculating the yaw angle of the work implement in the first posture based on a difference between the actual frame length and the assumed frame length; and calculating a position of the predetermined portion of the work implement based on the roll angle and the pitch angle of the work implement, and the yaw angle of the work implement in the first posture when the work implement is in the first posture.

8. The method according to claim 7, further comprising:

controlling the work implement based on the position of the predetermined portion of the work implement.

9. The method according to claim 7, wherein heights of a left end and a right end of the work implement in the first posture are different from each other, and the heights of the left end and the right end of the work implement in the second posture are the same.

10. The method according to claim 7, wherein the predetermined angle is zero degrees.

* * * * *